United States Patent [19]

Galow et al.

[11] 4,412,770

[45] Nov. 1, 1983

[54] CHARGING OF COKE OVENS AND METHOD

[75] Inventors: Manfred Galow, Essen; Nikolaus Stefancik, Düsseldorf, both of Fed. Rep. of Germany

[73] Assignees: Bergwerksverband GmbH; Didier Engineering GmbH, both of Essen, Fed. Rep. of Germany

[21] Appl. No.: 353,587

[22] Filed: Mar. 1, 1982

Related U.S. Application Data

[63] Continuation of Ser. No. 142,143, Apr. 14, 1980, abandoned.

[30] Foreign Application Priority Data

May 4, 1979 [DE] Fed. Rep. of Germany ..... 2918005

[51] Int. Cl.[3] ..... C10B 31/04

[52] U.S. Cl. ..... 414/162; 202/262; 414/171; 414/201; 414/786

[58] Field of Search ..... 414/162–164, 414/167, 171, 199–205, 786; 202/262; 193/31 R; 222/154

[56] References Cited

U.S. PATENT DOCUMENTS

| | | | |
|---|---|---|---|
| 3,070,242 | 12/1962 | Berczynski | 414/202 |
| 3,707,237 | 12/1972 | Wiemer | 414/162 |
| 3,951,750 | 4/1976 | Drebes | 414/163 X |

*Primary Examiner*—Robert G. Sheridan
*Attorney, Agent, or Firm*—Michael J. Striker

[57] ABSTRACT

A method and an apparatus is provided for charging particulate coal through ceiling holes into a coke oven. A conveyor above the coke oven ceiling is connected with each ceiling hole by a conduit. Mounted in the conduit is a first closure member which is movable to and from a position in which it permits gravity flow of coal from the conveyor to the ceiling hole. Also mounted in the conduit is a second closure member movable to and from a position in which it blocks the escape of gas from the ceiling hole. To charge, the second member is first moved to open position and thereupon the first member; when charging is completed the members are moved in reversed sequence to their closing positions.

15 Claims, 5 Drawing Figures

FIG. 1a
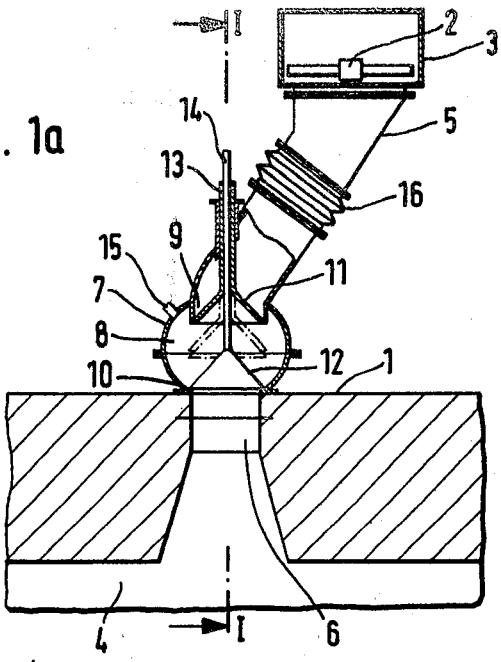
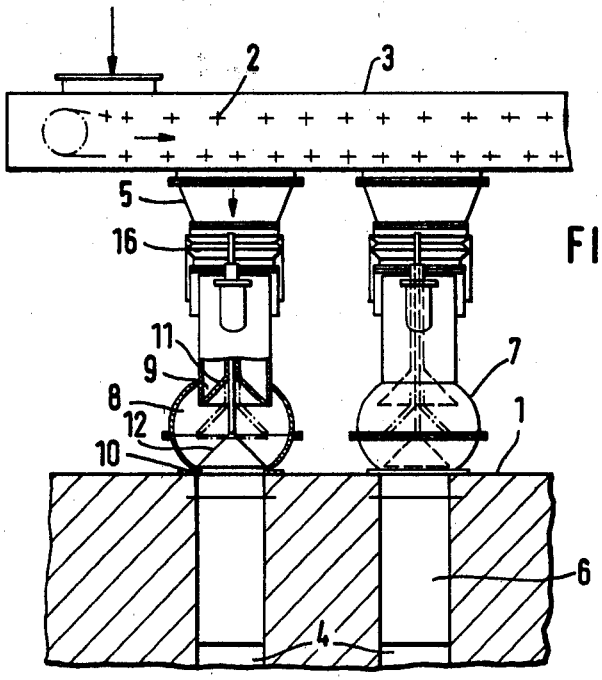
FIG. 1b

CHARGING OF COKE OVENS AND METHOD

This is a continuation of application Ser. No. 142,143, filed Apr. 14, 1980, now abandoned.

BACKGROUND OF THE INVENTION

This invention relates to the charging of coke ovens.

More particularly, the invention relates to a method of charging coke ovens and to apparatus for carrying out the method.

Coke ovens are generally arranged in batteries; i.e., a series of coke ovens is arranged side-by-side along a given path. The tops or ceiling of these ovens are provided with charging holes through which the coking material (e.g., particulate coal) is admitted. The most common way of supplying the coking material is by way of a larry car which runs on or above the coke oven ceilings and has one or more outlets that can be communicated with the charging holes to admit the coking material into the coke ovens under gravity.

Such larry cars are bulky and heavy and therefore require strong supports, which is reflected in coke oven costs. Moreover, charging of the coke ovens with larry cars is relatively time-consuming and labor-intensive, factors which are reflected in coke oven operating expenses. In recent years attempts have been made to improve the charging operation and reduce the expenses involved, by utilizing continuously operating feeders which transport the material lengthwise of the coke oven battery on or above the coke oven ceilings, and from which the material is discharged into the charging holes. These feeders have a number of charging conduits depending upon the number of coke oven chambers in the battery and communicating with the respective charging holes, as well as with requisite charge-control equipment to provide for controlled distribution of the coal into the individual oven chambers.

Different types of such feeders are known. For example, the feeder may be in form of a stationary conduit or pipe system through which the particulate coal is blown by means of an entraining gas (e.g., air) which may be hot so as to preheat the coal as it travels to the respective charging conduits. The feeder may, however, instead be a scraper conveyor which is installed in a tunnel-like enclosure extending lengthwise of the battery (i.e., transverse to the elongation of the coke oven chambers) atop the coke ovens. No matter what type of feeder is used, however, it is important to assure that during charging of the coke oven chambers the evolution of gases and dust is avoided as much as possible. This is difficult to accomplish. Especially if the coal is preheated the equipment will become rapidly fouled and this leads to a loss of sealing capability, a factor which is aggravated by the differential in the thermal expansion of the coke oven ceiling and the feeder components, respectively.

Further improvements are therefore most desirable but have not been forthcoming until now.

SUMMARY OF THE INVENTION

Accordingly, it is an object of the present invention to provide such further improvements.

A more particular object is to provide an improved method of charging coke oven chambers in such a manner as to avoid the evolution of dust and gas to a maximum feasible extent.

Another object is to provide an improved apparatus for carrying out the novel method.

A concomitant object is to provide an apparatus of the type in question which achieves the goal of charging with minimum evolution of dust and gas, with simple means assuring economic operation of the feeder without the danger of malfunction.

In keeping with the above objects and with still others which will become apparent hereafter, one aspect of the invention resides in an apparatus. Briefly stated, the apparatus may comprise first means for compensating stresses acting between the conveyor and the coke oven ceiling; second means in the passages for selectively permitting and blocking the flow of coal to the charging holes; and third means also in the passages for blocking the escape of gases from the charging holes.

Another aspect of the invention resides in the method which, briefly stated, may comprise the steps of moving a respective gas outflow-controlling element to a position in which the respective charging hole is unblocked; thereupon moving a coal-flow controlling element to a position in which coal can flow from the conveyor into the charging hole; moving the coal-flow controlling element to a position in which the flow of further coal is blocked, upon completion of the charging; and returning the gas outflow-controlling element to a position in which the charging hole is blocked to prevent the escape of raw gas from the coke oven.

The invention assures that those charging holes which are not being supplied with coal at any given time, are gas-tightly closed and that stresses between feeder and coke oven ceilings are compensated. The branch conduits, i.e., those admitting coal from the feeder into the charge holes, form closely above the charge holes respective airlock-like chambers which, when the charge holes are opened for charging with coal, will largely prevent the escape of raw gas from the respective coking chamber into and beyond the feeder. This means that fouling by deposition of gas and dust particles at the inner surfaces of the branch conduits is largely avoided, so that a deterioration of the gas and dust seals due to such depositions is avoided for prolonged periods of operating time.

A further feature of the invention is the generally bell-shaped or cone-shaped configuration of the closure elements used. Due to this shape the stream of coal particles flowing into a charging hole is forced to spread apart and flow in constant contact with the inner surface of the respective branch conduit; this causes friction which—at least in the region of the closure elements—scours off deposits which might form on the inner surface of the branch conduit, so that they cannot affect the proper sealing action.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1*a* is a fragmentary view, partly in vertical transverse section, of an apparatus embodying the invention;

FIG. 1*b* also shows the apparatus of FIG. 1*a*, but in a vertical longitudinal section;

DESCRIPTION OF THE PREFERRED EMBODIMENTS

Figure 2A:
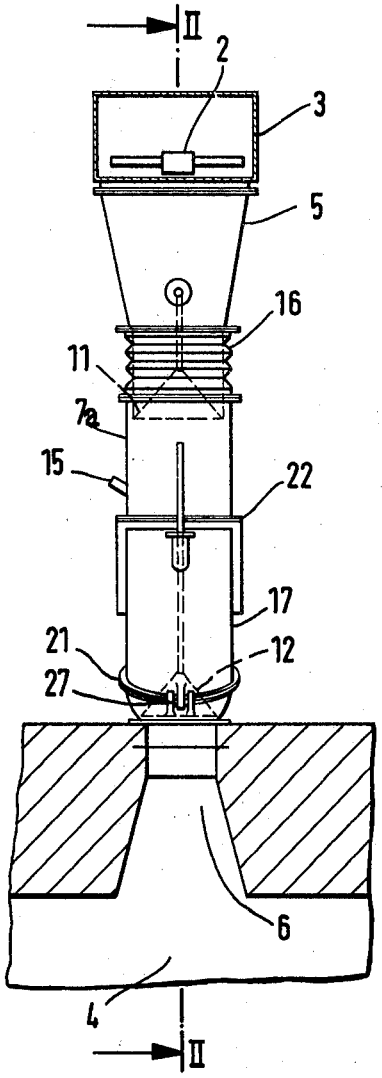
FIG. 2*a* is a view analogous to FIG. 1*a*, but illustrating another embodiment of the invention.

In the embodiment illustrated in FIGS. 1*a* and 1*b* the ceiling of a coke oven is designated with reference numeral 1 and only fragmentarily illustrated. The coke oven has coking chambers 4 (two shown in FIG. 1*b*) each provided with at least one charging hole 6 through the ceiling 1.

Arranged above a battery (not shown) comprised of a plurality of the illustrated coke ovens, is a scraper conveyor 2. This conveyor extends lengthwise of the coke oven battery, i.e., normal to the plane of FIG. 1*a* and parallel to the plane of FIG. 1*b*. It is surrounded by an elongated box-like or tunnel-like enclosure 3 which is stationary and provided above each charging hole 6 with an outlet funnel 5 having a branch pipe or conduit 7 which communicates with at least one of the charging holes 6. The conduit 7 is connected to the associated funnel 5 via a bellows-like compensator 16 (known per se) which serves to compensate for differential stresses between feeder and coke oven ceiling 1.

The lower end of conduit 7 can be closed with a bell-shaped or, as shown, a conical closure element 11 which opens or blocks the flow of coal into hole 6. Element 11 is mounted on a tubular rod 13 which can be raised and lowered by known-per-se (and therefore not illustrated) devices. A portion of the conduit 7 is shaped to form the illustrated generally spherical airlock-like chamber 8 in which the element 11 is movable and the lower open end 10 of which tightly engages the ceiling 1 circumferentially of the hole 6. The lower open end 10 registers with the upper open end 9 which can be opened or closed by the element 11. A second closure element 12 is provided to prevent the escape of raw gas from the hole 6; it is mounted on the lower end of a bar or rod 14 which is concentrically guided in rod 13 and can also be raised and lowered by known-per-se devices. It is advantageous if the devices operating (raising and lowering) the rods 13 and 14 are coupled with one another for coordinated operation.

The particulate coal, which is preferably preheated, is supplied in known manner to the scraper conveyor 2 (see the vertical arrow in FIG. 1*b*) and advanced by the same in direction of the horizontal arrow of FIG. 1*b*. When it reaches a respective funnel 5 it drops into the same and fills it and the conduit 7. The coal cannot leave the conduits 7, however, because these are still blocked by the elements 11 which are in their full-line blocking position (FIG. 1*a* and left side of FIG. 1*b*). When an oven chamber 4 is to be filled, the associated element 12 is raised and thereupon the associated element 11 is lowered, until they reach the median broken-line positions shown in FIG. 1*a*, in which they are telescoped (nested). The inner diameter of the chamber 8 at the median level of the elements 11, 12, is greater than the outer diameters of the elements 11, 12 only by an amount sufficient to define between the elements 11, 12 and the wall of chamber 8 a relatively narrow annular clearance. Since the coal particles rushing towards the hole under gravity are compelled to pass through this clearance— and thus to rub over the inner wall surface also above and below the clearance—they frictionally scour any deposits from the wall surface, thus providing a self-cleaning action. The flow of the coal can be influenced in a sense maximizing this self-cleaning action, by appropriately shaping the upper surface of the element 11; this is known per se.

When charging of a chamber 4 is completed, the element 11 is retracted (moved upwardly) until it blocks further flow of coal and is then arrested. The element 12 is now moved downwardly to seal hole 6 against the escape of gases. Any gas which has entered chamber 8 after element 11 blocked coal flow but before element 12 blocked the escape of gas, may be removed from chamber 8 through outlet 15 in suitable manner, for example by admitting an inert gas (e.g., nitrogen) via a not-illustrated port.

Figure 2B:
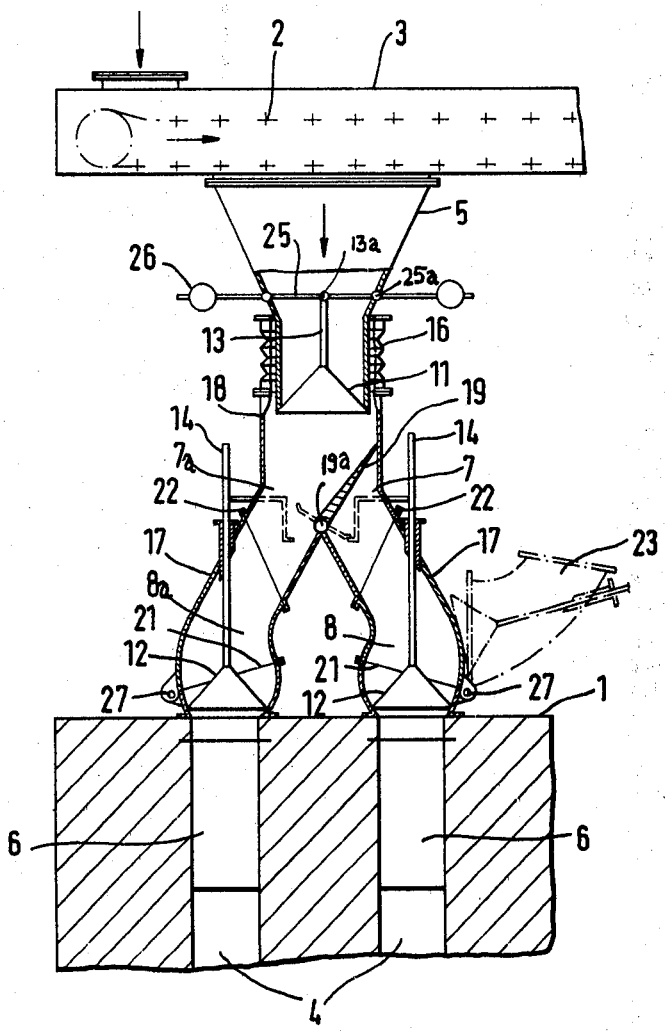
FIG. 2*b* is a view similar to the one in FIG. 1*b*, but of the embodiment in FIG. 2*a*.

In the embodiment of FIGS. 2*a* and 2*b* elements corresponding to those shown in FIGS. 1*a* and 1*b*, are identified with like reference numerals.

The FIG. 2 embodiment differs from the FIG. 1 embodiment essentially in that a single conduit 7*a* supplies two coking chambers 4 at once. For this purpose each conduit 7*a* (one shown) has its lower end configurated as a pair of chutes 17 (see FIG. 2*b*). The lower ends of the chutes 17 are shaped as part-spherical chambers 8*a* analogously to FIG. 1 each to cooperate with one charging hole 6 and each accommodating a sealing element 12 mounted on a respective vertically movable rod 14 (devices for moving the rods 14 are known per se, as already explained, for example fluid-operated cylinder units mounted on part 18. The upper portion of conduit 7*a* is in form of a tubular part 18 having an inner diameter larger than the inner diameter at the outlet of funnel 5 and surrounding this outlet with substantial clearance. A bellows-shaped compensator is arranged between part 18 and funnel 5; it serves not only to provide a gas-tight and dust-tight connection between them but also to prevent damage to conduit 7*a* due to thrust forces resulting from thermal expansion or other movements of the conveyor 2.

In this embodiment the closure element 11 is installed at the junction region of the funnel 5 and part 18. The actuating rod 13 of element 11 may have its upper end articulated at 13*a* to the inner ends of a pair of arms 25, each of which is in turn pivoted at 25*a* and carries a weight 26 at its outer end. The weights 26 pivot the arms 25 so that their inner ends and element 11 rise, until the element 11 engages with its upper surface the lower edge of the funnel 5 to gas-tightly close the same. When coal is present in funnel 5, it pushes element 11 down (e.g., to the illustrated position) so that it can escape into the chutes 17; when these have been emptied into the charging holes 6 and no further coal is present in funnel 5, the weights 26 automatically return the element 11 to its gastight sealing position.

A distributor flap 19 is mounted beneath element 21, where the conduit 11*a* splits off into the two chutes 17. It is turnable about a horizontal axis 19*a* and serves to divert coal into either one or the other of the chutes 17. Advantageously, the flap 19 may be operatively connected with the drives for the elements 12.

The operation of this embodiment is very similar to that of the FIG. 1 embodiment, except that prior to a charging operation the flap 19 is first placed into that one of its positions in which it will direct coal into the particular chute 17 to be used and prevent coal from entering the other chute. In the vicinity of the elements 12 the chutes 17 have an arcuate section 23 which extends between two outwardly diverging flange planes 21, 22 and can be tilted outwardly about an exteriorly located shaft 27 which is arranged in the lower plane 21. This permits the most stressed parts of a conduit 7*a* and the hole 6 to be made readily accessible for inspection, cleaning and/or maintenance. The section 23 and parts mounted on it (e.g., element 12 and rod 14) can be readily detached from shaft 27 and replaced.

The conduit 7*a* is so mounted in the region of the compensator 16, e.g., by flanging or the like, that it can be turned about its vertical axis in order to permit simultaneous charging through two holes 6 (with flap 19 vertical), or alternate charging through two holes 6 of a single chamber 4, for example to obtain more uniform filling of the chamber.

Figure 3:
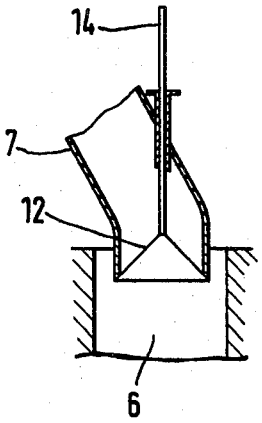
FIG. 3 is a diagrammatic fractional elevational view showing still another embodiment of the invention.

FIG. 3 shows that the element 12 can be constructed analogous to element 11, independently of the other structural characteristics, by having conduit 7 extend partway into the hole 6 and having its free lower end gastightly closed by e.g., upwardly drawing the element 12 against it. This feature may be used in the FIG. 1 and FIG. 2 embodiments.

The invention is susceptible of various modifications which are intended to be encompassed in the scope of the appended claims. For example, instead of being provided with two of the chutes 17 the conduit 7*a* could have four of them; this would e.g., permit the simultaneous charging of two chambers 4 through two holes 6 each. A single flap 19 could nevertheless still be used if simultaneous charging is to be effected through two holes 6; the appropriate angular position of the flap 19 about its axis would determine whether only one chamber 4 or two chambers 4 would be simultaneously charged through one hole 6 each or through two holes 6 each.

While the invention has been illustrated and described as embodied in a coking oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for charging particulate coal into charging holes in the ceiling of a coke oven from a conveyor above the ceiling and through passages formed by depending funnels having their lower ends connected to charging tubes, comprising first means for compensating stresses acting between the conveyor and the coke oven ceiling, said first means being a compensator interposed between the funnel and charging tube of a respective passage; second means in said passages for selectively permitting and blocking the flow of coal to the charging holes; third means also in said passages for blocking the escape of gases from the charging holes, said second and third means comprising respective closure elements each having a surface which faces away from, and also tapers in direction away from, the respective charging hole, said closure elements of said second means being mounted in the vicinity of the lower ends of the funnels, said charging tubes each having an upper cylindrical part communicating with the lower end of the funnel, and a plurality of lower tubular chute parts connected to a lower end portion of said cylindrical part and merging with each other in the vicinity of said lower portion; and a diverter flap movable between a plurality of diverting positions in which it diverts coal from the funnel to different ones of said lower chute parts.

2. Apparatus as defined in claim 1, said closure elements being of substantially conical shape.

3. Apparatus as defined in claim 1, said closure elements being substantially bell-shaped.

4. Apparatus as defined in claim 1, wherein the charing tubes have lower ends extending into the respective charging holes, and wherein said third means comprise closure elements located forwardly of said lower ends and movable to and from a position in which they sealingly abut the respective lover ends.

5. Apparatus as defined in claim 1, the charging tubes having lower end portions proximal to the charging holes, and said closure elements of said third means being mounted in said lower end portions adjacent the respective charging hole.

6. Apparatus as defined in claim 5, said lower end portions defining a chamber of part-spherical shape and said closure elements of said third means being movable therein between a first and a second position in which they respectively open and close the associated charging hole.

7. Apparatus as defined in claim 6, said lower end portions each having an inner diameter sufficiently large to define with an outer periphery of the respective closure element of the third means a relatively narrow annular gap when the closure element is in said first position thereof.

8. Apparatus for charging particulate coal into charging holes in the ceiling of a coke oven from a conveyor above the ceiling and through passages formed by depending funnels having their lower ends connected to charging tubes so that particulate coal flow via said funnels and charging tubes in a predetermined direction, the apparatus comprising first means for compensating stresses acting between the conveyor and the coke oven ceiling; second means in said passages for selectively permitting and blocking the flow of coal to the charging holes; and third means also in said passages for blocking the escape of gases from the charging holes, said first, second and third means being arranged successively one after the other in the direction of coal flow, so that said first means is located immediately downstream of the respective funnel, said second means is located downstream of said first means and said third means is located downstream of said second means and in immediate vicinity to the respective charging hole, each charging tube having a lower end portion in which said third means are located, and wherein each lower end portion includes a wall portion pivotable to and from a position in which it exposes the interior of the respective lower end portion to access from the exterior thereof, the respective wall portions being detachable from the associated charging tubes.

9. Apparatus for charging particulate coal into charging holes in the ceiling of a coke oven from a conveyor above the ceiling and through passages formed by depending funnels having their lower ends connected to charging tubes so that particulate coal flow via said funnels and charging tubes in a predetermined direction, wherein each charging tube has an upper cylindrical part communicating with the lower end of the funnel, and a plurality of lower tubular chute parts connected to a lower end portion of the cylindrical part and merging with each other in the vicinity of the lower portion; the apparatus comprising first means for compensating stresses acting between the conveyor and the coke oven ceiling; second means in said passages for selectively permitting and blocking the flow of coal to the charging holes; and third means also in said passages for blocking the escape of gases from the charging holes, said first, second and third means being arranged successively one after the other in the direction of coal flow, so that said first means is located immediately downstream of the respective funnel, said second means is located downstream of said first means and said third means is located downstream of said second means and in immediate vicinity to the respective charging hole; and a diverter flap movable between a plurality of diverting positions in which it diverts coal from the funnel to different ones of said lower chute parts, said third means comprising respective closure elements each movable between a charging-hole opening position and a charging-hole closing position and operatively connected with said flap to move between said opening and closing position in response to movement of said flap to different ones of said diverting positions.

10. Apparatus for charging particulate coal into charging holes in the ceiling of a coke oven from a conveyor above the ceiling and through passages formed by depending funnels having their lower ends connected to charging tubes so that particulate coal flow via said funnels and charging tubes in a predetermined direction, the apparatus comprising first means for compensating stresses acting between the conveyor and the coke oven ceiling; a second means in said passages for selectively permitting and blocking the flow of coal to the charging holes; and third means also in said passages for blocking the escape of gases from the charging holes, said first, second and third means being arranged successively one after the other in the direction of coal flow, so that said first means is located immediately downstream of the respective funnel, said second means is located downstream of said first means and said third means is located downstream of said second means and in immediate vicinity to the respective charging hole, each charging tube having a lower end portion in which said third means are located, and each lower end portion being pivotable as a whole together with said third means therein to and from a position in which it exposes the interior of the respective lower end portion to access from the exterior thereof.

11. A method of charging particulate coal into charging holes in the ceiling of a coke oven from a conveyor above the ceiling and through passages formed by depending channels connected to charging tubes through which particulate coal flows in a predetermined direction and extending from the conveyor to the charging holes and each having a stress compensating element, a coal-flow controlling element and a gas outflow-controlling element therein, and wherein each charging tubes has an upper cylindrical part communicating with the lower end of the funnel, and a plurality of lower tubular chute parts connected to a lower end portion of the cylindrical part and merging with each other in the vicinity of the lower portion, the method comprising the steps of compensating stresses acting between the conveyor and the coke oven ceiling at a location immediately downstream of the funnels in the coal flow direction; moving the respective gas outflow-controlling element, at a location downstream of the coal-flow controlling element and in immediate vicinity of the respective charging hole, to a position in which the respective charging hole is unblocked; thereupon moving the coal-flow controlling element, at a location downstream of the stress compensating element in the coal flow direction and upstream of the gas outflow-controlling element, to a position in which coal can flow from the conveyor into the charging holes; moving the coal-flow controlling element to a position in which the flow of further coal is blocked, upon completion of the charging; returning the gas outflow-controlling element to a position in which the charging hole is blocked to prevent the escape of raw gas from the coke oven; and moving a diverter flap between a plurality of diverting positions in which it diverts coal from the funnel to different ones of the lower chute parts; and operatively connecting the respective gas outflow-controlling elements with the flap to move between the blocking and unblocking positions in response to movement of the flap to different ones of said diverting positions.

12. A method of charging particulate coal into charging holes in the ceiling of a coke oven from a conveyor above the ceiling and through passages formed by depending channels connected to charging tubes through which particulate coal flows in a predetermined direction, and extending from the conveyor to the charging holes and each having a stress compensating element, a coal-flow controlling element and a gas outflow-controlling element therein, wherein the gas outflow-controlling element is located in a lower end portion of the respective charging tube, the method comprising the steps of compensating stresses acting between the conveyor and the coke oven ceiling at a location immediately downstream of the funnels in the coal flow direction; moving the respective gas outflow-controlling element, at a location downstream of the coal-flow controlling element and in immediate vicinity to the respective charging hole, to a position in which the respective charging hole is unblocked; thereupon moving the coal-flow controlling element, at a location downstream of the stress compensating element in the coal flow direction and upstream of the gas outflow-controlling element, to a position in which coal can flow from the conveyor into the charging holes; moving the coal-flow controlling element to a position in which the flow of further coal is blocked, upon completion of the charging; returning the gas outflow-controlling element to a position in which the charging hole is blocked to prevent the escape of raw gas from the coke oven; and pivoting each lower end portion of said charging tube as a whole together with said third means therein to and from a position in which it exposes the interior of the respective lower end portion to access from the exterior thereof.

13. Apparatus for charging particulate coal into charging holes in the ceiling of a coke oven from a conveyor above the ceiling and through passages formed by depending funnels having their lower ends connected to charging tubes, the charging tubes having lower end portions proximal to the charging holes and defining a chamber of part-spherical shape, the chambers each having an upper opening and a registering lower opening which communicates with the associated charging hole, the apparatus comprising first means for compensating stresses acting between the conveyor and the coke oven ceiling; second means in said passages for selectively permitting and blocking the flow of coal to the charging holes; and third means also in said passages for blocking the escape of gases from the charging holes, said second and third means comprising respective closure elements each having a surface which faces away from, and also tapers in direction away from, the respective charging hole, said closure elements of said third means being mounted in said lower end portions adjacent the respective charging hole and movable between a first and a second position in which they respectively open and close the associated charging hole, said chambers each accommodating an element of said second means and therebelow an element of said third means, said element of said second means being upwardly concave so that the element of said third means can at least partially nest therein, said elements being jointly and severally movable between the respective positions thereof.

14. Apparatus as defined in claim 13, said element of said third means having a height and a diameter corresponding at least substantially to the height and diameter of the concavity in the element of the second means.

15. Apparatus as defined in claim 13; further comprising a hollow vertically displaceable first rod slidable in said chamber and carrying said element of said second means, and a second rod slidably extending through said first rod and carrying said element of said third means below said element of said second means.

* * * * *